US010604289B2

(12) United States Patent
Andersen

(10) Patent No.: US 10,604,289 B2
(45) Date of Patent: Mar. 31, 2020

(54) SWIVEL ARRANGEMENT HAVING STERILE AIR FLOW

(71) Applicant: Tetra Laval Holdings & Finance S.A., Pully (CH)

(72) Inventor: Lasse Andersen, Sweden (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 263 days.

(21) Appl. No.: 15/739,624

(22) PCT Filed: Jun. 23, 2016

(86) PCT No.: PCT/EP2016/064518
§ 371 (c)(1),
(2) Date: Dec. 22, 2017

(87) PCT Pub. No.: WO2017/001274
PCT Pub. Date: Jan. 5, 2017

(65) Prior Publication Data

US 2018/0178939 A1 Jun. 28, 2018

(30) Foreign Application Priority Data

Jul. 1, 2015 (SE) ..... 1550933

(51) Int. Cl.
*B67C 3/00* (2006.01)
*B65B 55/10* (2006.01)
(Continued)

(52) U.S. Cl.
CPC ..... *B65B 55/10* (2013.01); *B65B 3/00* (2013.01); *B67C 3/04* (2013.01); *B67C 3/22* (2013.01); *B67C 2003/228* (2013.01)

(58) Field of Classification Search
CPC ..... B65B 55/10; B65B 55/18; B65B 31/04; B65B 31/044; B67C 3/00; B67C 3/06;
(Continued)

(56) References Cited

U.S. PATENT DOCUMENTS 2,140,187 A * 12/1938 Kantor ..... B67C 3/06 53/432
6,817,386 B2 * 11/2004 Tsukano ..... B67C 3/04 141/57
(Continued)

FOREIGN PATENT DOCUMENTS

DE 10 2013 110016 A1 3/2015

OTHER PUBLICATIONS

PCT Written Opinion of the International Searching Authority for Application No. PCT/EP2016/064519 dated Sep. 7, 2016 in 4 pages.

(Continued)

*Primary Examiner* — Reinaldo Sanchez-Medina
(74) *Attorney, Agent, or Firm* — Knobbe, Martens, Olson & Bear, LLP

(57) ABSTRACT

A device and method that relates to a swivel arrangement for a carousel filler arrangement having a rotating tank and a product pipe for transporting product into the rotating tank are disclosed. The swivel arrangement may include a tank connecting part, a pipe connecting part, a first opening for receiving a gaseous media, and a second opening for ejecting the gaseous media. A first channel may be partly defined by a protruding portion of the pipe connecting part and an outer wall of the product pipe, and a second channel may be partly defined by the protruding portion and a protruding portion of the tank connecting part. A gap may be formed between the pipe connecting part and the protruding portion of the tank connecting part, the gap may be located between
(Continued)

the second channel and the second opening thereby forming a particle barrier whereby, when in use, particles are hindered from entering the second channel by a flow of gaseous media from the first opening to the second opening via the first and second channels.

13 Claims, 7 Drawing Sheets

(51) Int. Cl.
*B67C 3/22* (2006.01)
*B65B 3/00* (2006.01)
*B67C 3/04* (2006.01)

(58) Field of Classification Search
CPC .. B67C 3/10; B67C 3/12; B67C 3/225; B67C 3/2614
See application file for complete search history.

(56) References Cited

U.S. PATENT DOCUMENTS 8,955,562 B2 * 2/2015 Krulitsch ..... B67C 3/2637 141/146
2016/0194188 A1 * 7/2016 Clusserath ..... B08B 9/283 141/7
2016/0214845 A1 * 7/2016 Clusserath ..... B67C 3/10
2016/0221701 A1 * 8/2016 Niehr ..... B67C 3/22

OTHER PUBLICATIONS

International Search Report for Application No. PCT/EP2016/064519 dated Sep. 7, 2016 in 2 pages.

* cited by examiner

SWIVEL ARRANGEMENT HAVING STERILE AIR FLOW

TECHNICAL FIELD

The present invention relates to a swivel arrangement for a carousel filler arrangement, further the present invention relates to a carousel filler having such a swivel arrangement.

BACKGROUND ART

In food processing industry, carousel fillers are used to fill packages with different types of beverages. In order to ensure that certain types of beverages, e.g. beverages containing particles or media which may sediment, are evenly distributed and/or that the quality is uniform the carousel filler may have a rotating tank. The product is supplied to the rotating tank through a product pipe extending from a product supply means above the tank, and into the tank through a swivel arrangement. In order to keep the environment in the tank sterile, the swivel arrangement may be subjected to, or contain channels for hot steam and/or channels for sterile air. Hence, the requirements on the sterile environment for the tank and/or product leads to a complex design of the swivel arrangement which inherently consume much energy such as e.g. heated steam. Further, due to the above consideration for keeping a sterile environment, the rotational speed of the rotating tank and thus the carousel filler is limited, as components such as bearings and bushings taking up large amount of the load would otherwise wear out with an unacceptable frequency. Furthermore, particles from within the swivel arrangement e.g. stemming from the bearings or sealings, as well as particles from outside of the swivel arrangement may penetrate into the rotating tank and contaminate the product therein. Even if the particles become sterilized before entering the rotating tank (e.g. by the hot steam), it is undesired to have such particles mixed with the product.

Hence, there is a generally desire to improve the sterile environment and to at least reduce the risk of having particles mixed up with the product. Furthermore there is a desire to provide reduced costs and improved performance. One desired effect may be to provide a less contaminated product and/or a more sterile environment and/or improved sterilization. Another desired effect may be a swivel arrangement which allows an increased rotational speed. The increased rotational speed would be advantageous in terms of the filling speed for each package and thus the related cost. Another desired effect may be a reduced cost for maintenance. There is thus a need for improving the state of the art to provide for a swivel arrangement for a carousel filler which at least partly solves these problems or provides the desired effect.

SUMMARY OF THE INVENTION

It is an object of the present invention to improve the current state of the art, to solve at least some of the above problems, and to provide an improved swivel arrangement and thus an improved carousel filler arrangement. These and other objects are achieved by a swivel arrangement for a carousel filler arrangement.

According to a first aspect of the present invention, there is provided a swivel arrangement for a carousel filler arrangement having a rotating tank and a product pipe for transporting product into the rotating tank. The swivel arrangement comprises a tank connecting part arranged to rotate with the rotating tank, a pipe connecting part arranged to at least partly surround the tank connecting part, a first opening at least for receiving a gaseous media, a second opening at least for ejecting the gaseous media, a first channel being in fluid communication with the first opening, the first channel being at least partly defined by a protruding portion of the pipe connecting part and an outer wall of the product pipe, a second channel being in fluid communication with the first channel, the second channel being at least partly defined by the protruding portion and a protruding portion of the tank connecting part. A gap is formed between the pipe connecting part and the protruding portion of the tank connecting part, the gap being located between the second channel and the second opening thereby forming a particle barrier whereby, in use, particles are hindered from entering the second channel by a flow of gaseous media from the first opening to the second opening via the first and second channels.

The present invention is at least partly based on the realization by forming a gap between a second channel being at least partly defined by the protruding portion of the pipe connecting part and the protruding portion of the tank connecting part and the second opening at least for ejecting the gaseous media, a particle barrier is formed at the gap by a flow of gaseous media from the first opening to the second opening such that particles are hindered from entering the second channel and thereby entering the rotating tank, where they may contaminate the product. Hereby, the steam sterilization function may be reduced or even dispensed with. In other words the particle barrier may allow a designer to dispense with e.g. steam barriers for sterilizing particles as there is less risk that contaminating particles enter the rotating tank. Another alternative advantage is that the particle barrier may be used concurrently with e.g. a steam barrier in order to improve the sterilization and reduce the risk for any contaminating particles to enter the tank.

The product pipe of the carousel filler arrangement extends into the tank in order to transport, i.e. refill or fill, product into the tank. As the product pipe is further connected to other parts such as pumps, filter and processing equipment before the product reaches the carousel filler arrangement the product pipe is stationary and non-rotating.

The swivel arrangement may also be known as a manifold assembly, as the purpose of the swivel arrangement is to connect the rotating tank to the product pipe and possibly to other connections while allowing the rotating tank to, in use, rotate.

The gaseous media may be any suitable gaseous media which is sterile, such as sterilized air and/or Nitrogen.

In at least one embodiment of the invention, the size of the gap may be configured such that a pressure drop over the gap is adapted to create a uniform flow through the gap. The pressure drop may be adapted by configuring the size of the gap or the curvature of the gap for the flow of gaseous media through the gap, or the curvature of the interior surfaces in connection with the gap, e.g. the protruding portion of the tank connection part and/or the interior surfaces of the pipe connecting part. A uniform flow may ensure that there is less risk for particles which may contaminate the product in the rotating tank to be transported through the gap in the direction opposite the flow of the gaseous media.

In various embodiments of the invention, the gap may be 5-30 mm wide.

In at least one embodiment of the invention, the swivel arrangement may further comprise a curved chamber. The curved chamber may be arranged in fluid communication with the gap and the second opening. The curved chamber may extend circumferentially around the protruding portion of the tank connecting part. Thus, the curved chamber may be arranged radially outwards with respect to the protruding portion of the tank connecting part The swivel arrangement may further comprise a third channel being in fluid communication with the curved chamber and the second opening. The third channel may be arranged at least partly tangentially with respect to the curved chamber. The third channel directs the flow of gaseous media to the second opening. Furthermore, by having a tangential connection between the third channel and the curved chamber, a flow entering the second opening and reaching the curved chamber via the third channel, such as e.g. a cleaning liquid, may be injected into the curved chamber and subsequently the second channel with an increased velocity. Thereby, cleaning of the curved chamber and/or the second channel may be facilitated.

In various embodiments of the invention, the swivel arrangement may further comprise a metal bushing arranged between the pipe connecting part and the protruding portion of the tank connecting part. The metal bushing may be in mechanical contact with the tank connecting part and/or the pipe connecting part to bear at least a portion of the load which is applied due to the rotation of the tank connecting part during use. The metal bushing may thus reduce the wear and tear on other components of the swivel arrangement arranged between tank connecting part and the pipe connecting part.

The swivel arrangement may further comprise at least one seal arranged between the metal bushing and the pipe connecting part, and may further comprise at least one seal arranged between the metal bushing and the protruding portion of the tank connecting part.

In at least one embodiment of the invention, the swivel arrangement may further comprise at least two rolling bearings. The at least two rolling bearings may be arranged between the protruding portion of the tank connecting part and the pipe connecting part, and the at least two rolling bearing may be spaced apart from each other. The at least two rolling bearings enables the tank connecting part and the pipe connecting part to rotate substantially freely with respect to each other. That the at least two rolling bearings are spaced apart results in that the rolling bearings may bear at least a portion of the load which is caused by the rotation of the tank connecting part during use. The at least two rolling bearings may be spaced apart by a distance corresponding to at least half the length of the protruding portion of the tank connecting part.

In various embodiments of the invention, the swivel arrangement may further comprise a steam inlet, a steam outlet, and a steam channel formed in the pipe connecting part between the steam inlet and the steam outlet. At least an inner wall of the steam channel comprises a surface of the metal bushing. During use, steam is lead through the steam channel from the steam inlet to the steam outlet via the steam channel, thereby sterilizing any contaminants or particles which may have entered the swivel arrangement and reached the position of the metal bushing.

In at least one embodiment of the invention, the first channel and the second channel may be substantially parallel. The second channel may thus be interpreted as being at least partly located radially outwards with respect to the first channel.

In at least one embodiment, the swivel arrangement may further comprise at least one spray nozzle arranged at an end portion of the protruding portion of the pipe connecting part. The at least one spray nozzle may be used during a cleaning process where a cleaning media is led through the first channel, the spray nozzle then sprays and directs the cleaning media towards the inside of the rotating tank. In embodiments where there is more than one spray nozzle, the spray nozzles may be arranged symmetrically towards an end of the protruding portion of the pipe connecting part. Hence, in an embodiment with three spray nozzles, the spray nozzles may be arranged with 120° between them. The spray nozzle may be formed as a through hole in the protruding portion of the pipe connecting part.

In at least one embodiment of the invention, the swivel arrangement may further comprise an intermediate part arranged between the tank connecting part and the pipe connecting part, the intermediate part being arranged to rotate with a rotational speed different from a rotational speed of the tank connecting part. An intermediate part arranged between a tank connecting part and a pipe connecting part for a carousel filler arrangement having a rotating tank and an product pipe for transporting product into the tank allows the relative speed between the tank connecting part and the pipe connecting part to be reduced as the intermediate part is arranged to rotate with a rotational speed different from a rotational speed of the tank connecting part. Hence, components comprised in the swivel arrangement experiences less wear and tear. Thus, the swivel arrangement may have an increased lifetime and may increase the lifetime of components within the swivel arrangement. Another advantage is that since the intermediate part reduces the relative speed, the tank connecting part, and hence the rotating tank, may be allowed to rotate with an increased rotational speed. Hence, the present invention may also be used to provide a carousel filler arrangement with a higher rotational speed which may be used to fill more packages per hour.

That the intermediate part is arranged to rotate with a rotational speed which is different from the rotational speed of the tank connecting part should mainly be construed as the intermediate part having a rotational speed which is less than the rotational speed of the tank connecting part.

In some embodiments of the invention, the intermediate part may be arranged to rotate at a rotational speed of half, or approximately half, the rotational speed of the tank connecting part. By arranging the intermediate part to rotate at half, or approximately half, the rotational speed of the tank connecting part less wear and tear is inflicted on the component of the swivel arrangement.

According to at least a further aspect of the present invention, a method for operating the swivel arrangement for a carousel filler arrangement having a rotating tank and a product pipe for transporting product into the rotating tank is provided. The method comprises the steps of feeding a liquid product through the product pipe into the rotating tank, and providing a flow of gaseous media from the first opening to the second opening via said first and second channels.

The method may further optionally comprise the step of providing a flow of steam through a steam channel arranged in the pipe connecting part from a steam inlet to a steam outlet.

According to a further aspect of the present invention, a method for cleaning the swivel arrangement for a carousel filler arrangement having a rotating tank and a product pipe for transporting product into the rotating tank is provided. The method comprises the steps of providing a cleaning media through the product pipe into the rotating tank, providing a cleaning media through the first opening into said rotating tank via the first channel, providing a cleaning media through the second opening into the rotating tank via the second channel, and providing steam through said product pipe, said first opening and said steam inlet.

The step of providing a cleaning media through the second opening into the rotating tank via the second channel, may comprise providing the cleaning media through the third channel, and curved chamber.

The term providing cleaning media may be understood as feeding or creating a flow of cleaning media in either gaseous or liquid form in order to clean and/or sterilize the internal surfaces of at least the swivel arrangement.

Effects and features of these further aspects of the present invention are largely analogous to those described above in connection with the first aspect of the inventive concept. Embodiments mentioned in relation to the first aspect of the present invention are largely compatible with the second aspect of the invention.

Generally, all terms used in the claims are to be interpreted according to their ordinary meaning in the technical field, unless explicitly defined otherwise herein. All references to "a/an/the [element, device, component, means, step, etc.]" are to be interpreted openly as referring to at least one instance of said element, device, component, means, step, etc., unless explicitly stated otherwise.

BRIEF DESCRIPTION OF THE DRAWINGS

The above, as well as additional objects, features and advantages of the present invention, will be better understood through the following illustrative and non-limiting detailed description of embodiments of the present invention, with reference to the appended drawings, where the same reference numerals will be used for similar elements, wherein.

DETAILED DESCRIPTION OF PREFERRED EMBODIMENTS OF THE INVENTION

In the present detailed description, embodiments of a carousel filler arrangement and swivel arrangement according to the present invention are mainly discussed with reference to cross sectional schematic views showing a swivel arrangement according to various embodiments of the invention. It should be noted that this by no means limits the scope of the invention, which is also applicable in other circumstances for instance with other types or variants of carousel fillers or devices than the embodiments shown in the appended drawings. Further, that specific components are mentioned in connection to an embodiment of the invention does not mean that those components cannot be used to an advantage together with other embodiments of the invention. The invention will now be described with reference to the enclosed drawings where first attention will be drawn to the structure, and secondly to the function.

Figure 1:
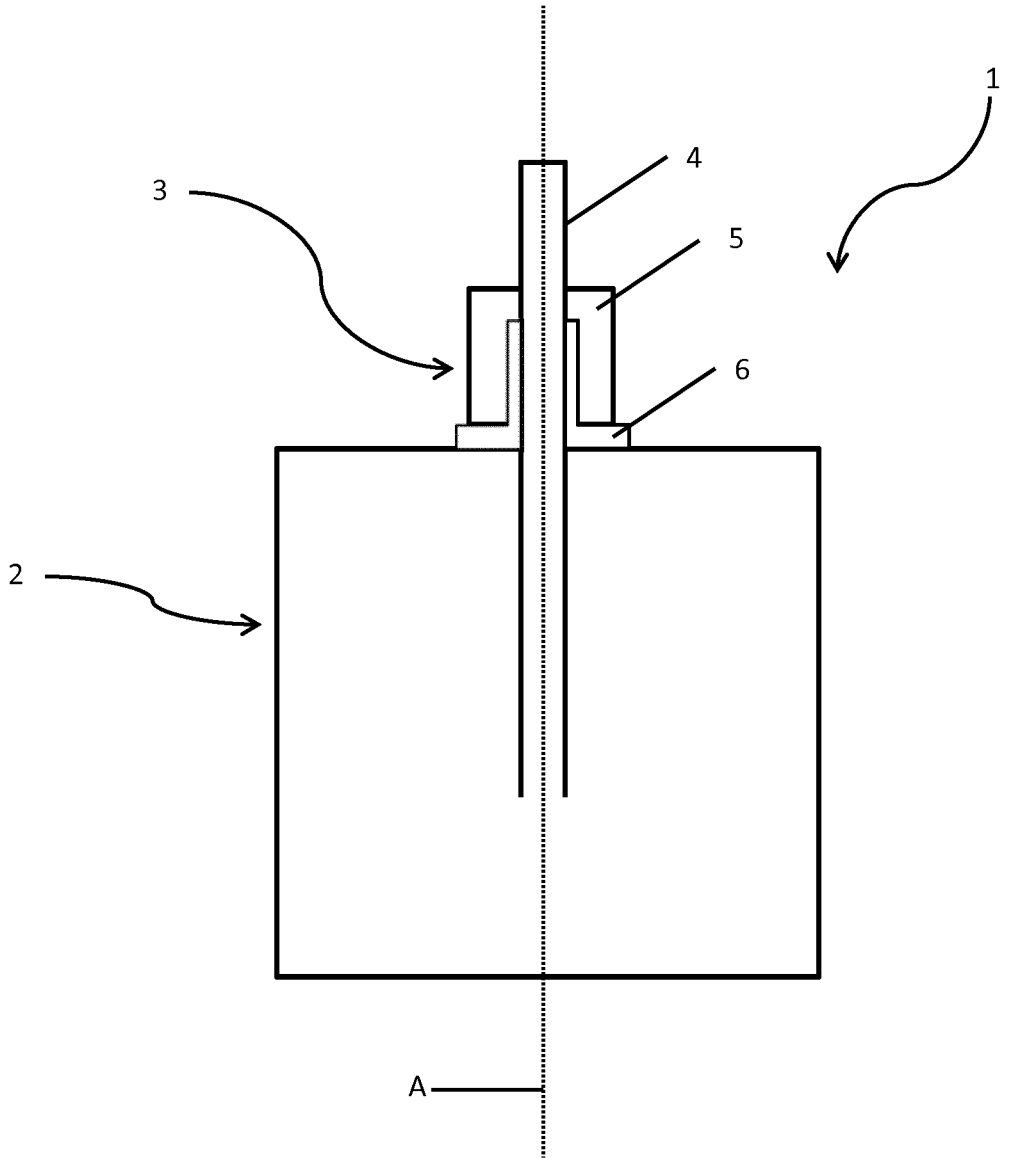
FIG. 1 is a cross-sectional schematic view of portions of a carousel filler arrangement in accordance with at least one embodiment of the invention.

FIG. 1 shows a cross-sectional schematic view of a carousel filler arrangement 1 in accordance with one embodiment of the present invention. The carousel filler arrangement comprises a rotating tank 2, a swivel arrangement 3 and a product pipe 4. It should of course be noted that a complete carousel filler arrangement comprises more components than the ones shown herein in order to properly function such as pipe and valves leading to packages to be filled by the liquid product in the rotating tank 2. However, such components are left out as many alternatives are known in the art and the focus of the present invention is the swivel arrangement 2. Further, it is understood that the carousel filler arrangement 1, the rotating tank 2, the swivel arrangement 3 and the product pipe 4 are substantially rotationally symmetric around a common axis A which is also the axis of rotation for the rotating tank 2 and the swivel arrangement 3.

The swivel arrangement 3 comprises a tank connecting part 6 and a pipe connecting part 5. The pipe connecting part 5 at least partly surrounds the tank connecting part 6 in a radial direction as seen from the rotational axis A. The tank connecting part 6 is mounted on and attached to the rotating tank 2, such that the tank connecting part 6, in use, rotates with the rotating tank 2. The product pipe 4 is arranged to transport a product in liquid form into the tank 2. The product pipe 4 therefore extends into the rotating tank 2, from above the rotating tank 2 as shown in FIG. 1. Hence, the swivel arrangement 3 is understood to be mounted on top of the rotating tank 2. The product pipe 4 is stationary and non-rotating as valves and other connection which feed the product from other parts of the production into the product pipe 4 limits the movement of the product pipe 4. The product pipe 4 is connected to the pipe connecting part 5 of the swivel arrangement 3.

In use, the rotating tank 2 rotates around the axis of rotation A. The axis of rotation A may be the common axis of rotation, e.g. substantially the same axis of rotation as the axis of rotation for the tank connecting part 6. The rotating tank 2 and thus the tank connecting part 6 is arranged to rotate at at least 12 RPM, and preferable at at least 20 RPM, and more preferably at at least 24 RPM. While the rotating tank 2 rotates, pipe and valves (not shown) fill packages (not shown) in the vicinity of the carousel filler arrangement 1 with the liquid product kept in the rotating tank 2. The amount of liquid product in the rotating tank 2 may be kept substantially constant by continuously refilling the rotating tank 2 through the product pipe 4.

Figure 2:
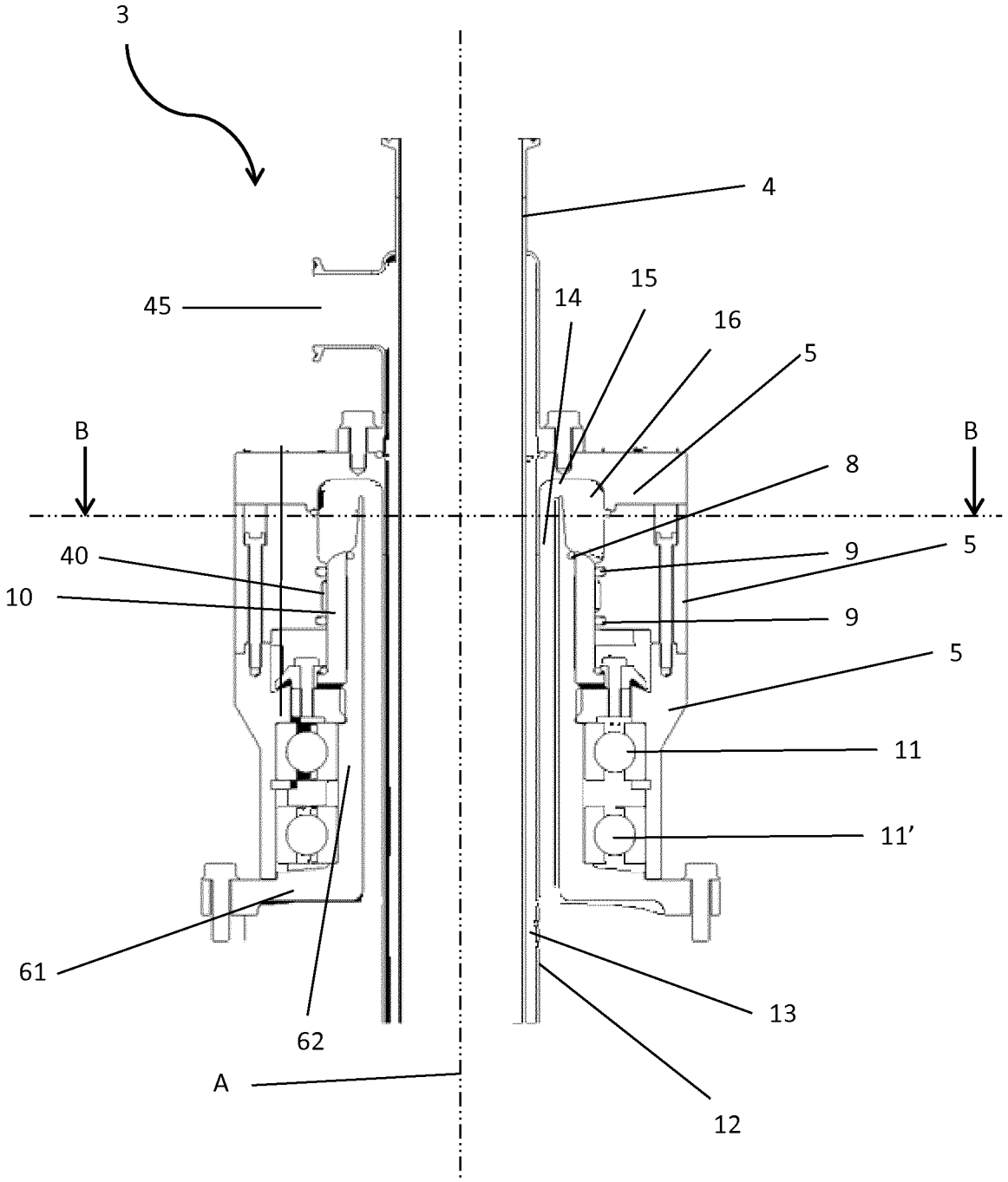
FIG. 2 is a cross-sectional schematic view of a swivel arrangement for a carousel filler arrangement in accordance with at least one embodiment of the invention.
Figure 3:
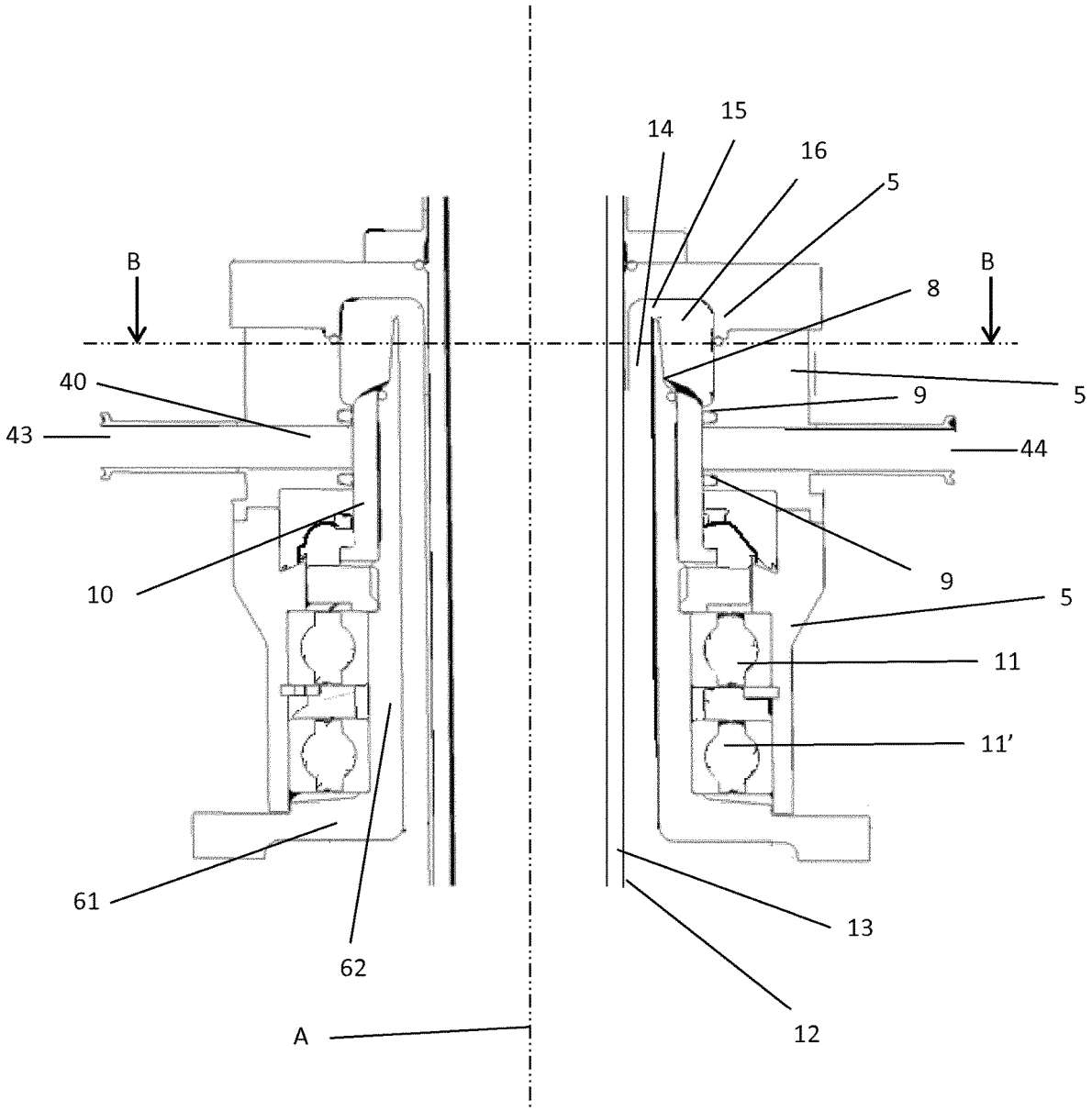
FIG. 3 is a cross-sectional schematic view of a swivel arrangement for a carousel filler arrangement in accordance with at least one embodiment of the invention.

FIGS. 2 and 3 show a more detailed cross sectional view of the swivel arrangement 3 in accordance with at least one embodiment of the invention. Note that the tank connecting part 6 comprises a base plate 61 and a protruding portion 62 which extends from the base plate 61. The base plate 61 has a radial extension from the axis of rotation A and the protruding portion 62 extends in parallel with the axis of rotation A. Hereby, it is understood that protruding portion 62 of the tank connecting part is shaped in the form of a cylinder, and that the pipe connecting part 5 is at least partly formed as a cylinder which at least partly surrounds the protruding portion 62 of the tank connecting part. The pipe connecting part 5 thus surrounds the protruding portion 62 of the tank connecting part in the radial direction from the axis of rotation A.

Note that the pipe connecting part 5 shown in FIG. 2 comprises several subparts or subcomponents which are connected to each other. It is of course also possible that the pipe connecting part 5 is manufactured or formed in a single piece. By forming the pipe connecting part 5 from several subparts the swivel arrangement 3 may be easier to assemble.

The swivel arrangement 3 comprises a metal bushing 10 arranged between the tank connecting part 6 and the pipe connecting part 5, in particular between the protruding portion 62 of the tank connecting part and the pipe connecting part 5. The metal bushing 10 may be in mechanical contact with the protruding portion 62 of the tank connecting part and/or the pipe connecting part 5 in order to bear at least a portion of the load which is applied due to the rotation of the tank connecting part 6 during use.

The swivel arrangement 3 comprises two seals 9 arranged between the metal bushing 10 and the pipe connecting part 5. The swivel arrangement 3 also comprises a seal 8 arranged between the metal bushing 10 and the protruding portion 62 of the tank connecting part. The two seals 9 are configured to seal the path between the pipe connecting part 5 and the metal bushing 10, and the seal 8 is configured to seal the path between the metal bushing 10 and the protruding portion 62 of the tank connecting part. The seals 8 and the seal 9 may be made of any suitable material such as rubber, synthetic rubber, a plastic, a ceramic or the like.

The swivel arrangement further comprises at least two rolling bearings 11, 11' arranged between the protruding portion 62 of the tank connecting part and the pipe connecting part 5 in order to allow them to freely rotate with respect to each other. Note that the first rolling bearing 11 is spaced apart, along the axial direction, from the second rolling bearing 11' by being mounted further up in the swivel arrangement. As the two rolling bearing 11, 11' are spaced apart, the load during use, e.g. when the tank connecting part 6 rotates may be more evenly distributed on the first rolling bearing 11, the second rolling bearing 11' and the metal bushing 10 arranged in the swivel arrangement 3. The first and second rolling bearing 11, 11' may be spaced apart by a distance which larger than the one shown in FIGS. 2 and 3. For example, the first and second rolling bearing 11, 11' may be spaced apart by a distance corresponding to half the length of the protruding portion 62 of the tank connecting part.

The pipe connecting part 5 comprises a protruding portion 12 extending in parallel with the product pipe 4. The protruding portion 12, such as an inner surface of the protruding portion 12, together with the outer wall of the product pipe 4 defines a first channel 13. The protruding portion 12, such as an outer surface of the protruding portion 12, also defines a second channel 14 together with protruding portion 62, such as an inner surface of the protruding portion 62 of the tank connecting part. The second channel 14 is in fluid communication with a gap 15 defined between the protruding portion 62 of the tank connecting part 6 and the pipe connecting part 5. The gap 15 is in fluid communication with a chamber 16.

The size, e.g. the width between the upper end of the protruding portion 62 of the tank connecting part and the interior surfaces of the pipe connecting part 5 in the vicinity of the gap 15 may be configured such that a pressure drop over the gap is adapted to create a uniform flow through the gap 15. The pressure drop may be adapted through configuring the size of the gap 15 or the curvature of the gap for the flow of gaseous media at the gap, or the curvature of the interior surfaces in connection with the gap, e.g. the protruding portion 62 of the tank connecting part and the interior surfaces of the pipe connecting part 5. A uniform flow may ensure that there is less risk for particles which may contaminate the product in the rotating tank 2 to be transported through the gap 15 in the direction opposite the flow of gaseous media.

The swivel arrangement 3 further comprises a first opening 45 at least for receiving a gaseous media. The first opening 45 may be arranged outside the pipe connecting part 5 as shown in FIG. 2. As mentioned above, the first channel 13 at least partly defined by the protruding portion 12 of the pipe connecting part and an outer wall of the product pipe 4. The first channel 13 terminates in the tank at a tank opening (not shown) such that a flow of gaseous media which enters the first opening 45 is led through the first channel 13 to the tank opening (not shown), and may then enter the second channel 14, which is thereby in fluid communication with the first channel 14 via the rotating tank 2. The second channel 14 is at least partly defined by the protruding portion 12 of the pipe connecting part and the protruding portion of the tank connecting part 62. The gap 15 is located between the second channel 14 and a second opening 46 shown in FIG. 4. During use, a continuous flow of gaseous media is directed from the first opening 45 to the second opening 46 via the first and second channels 12, 13. Thereby, a particle barrier is formed such that particles are hindered from entering the second channel 14 and falling into the tank where they may contaminate the product. The particle barrier is thus provided at least partly by the positive flow of a gaseous media through the second channel 14, and the gap 15, and partly by the protruding portion 62 of the tank connecting part which extends further than the bottom surface of the curved chamber 16 such that the force of gravity pulls particles which have entered the chamber 16 away from the gap 15.

Figure 4:
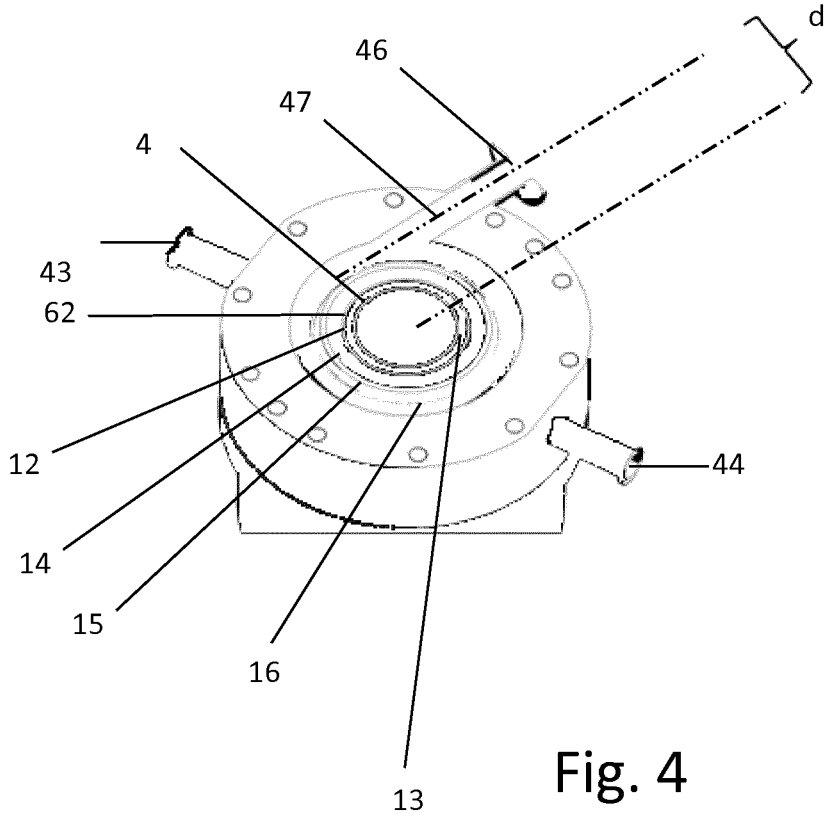
FIG. 4 is a perspective view of a cross-sectional view of a swivel arrangement for a carousel filler arrangement in accordance with at least one embodiment of the invention.

Now referring to FIG. 4, note the in general cylindrical symmetry of the components of the swivel arrangement 3 arranged in concentric rings around the product pipe 4 at the center. The product pipe 4 is surrounded in a radial direction by the first channel 13 and then the protruding portion 12 of the pipe connecting part, which in turn is surrounded in a radial direction by the second channel 14 and then the protruding portion 62 of the tank connecting part. The gap 15 is arranged between the second channel 14 and the chamber 16, and thus radially outwards from the second channel 14. The chamber 16 is a curved chamber 16 which extends circumferentially around the protruding portion 62 of the tank connecting part.

The swivel arrangement further comprises a third channel 47 in fluid communication with the curved chamber 16 and the second opening 46. The third channel 47 is arranged at least partly tangentially with respect to the curved chamber 16. Hence, as shown in FIG. 4 the central axis of the third channel 47 may be arranged at a distance d corresponding to approximately the radius of the curved chamber. The distance d may vary and be adapted to correspond to the radius of the curved chamber, or a portion of the radius of the curved chamber. The distance d may vary in between 1.3 to 0.7 times the radius of the curved chamber, e.g. the distance de may be larger or smaller than the radius of the curved chamber. The tangential arrangement or placement of the third channel 47 may allow a flow of gaseous media being injected through the second opening 46 and third channel 47 to retain a high flow velocity. Hence, if the second opening 46 is used as an inlet during e.g. a cleaning process, the tangential arrangement or placement of the third channel 47 allows a flow of media, such as e.g. a flow of the gaseous media or a flow of a liquid media, flowing through the third channel 47 to retain a flow speed through the curved chamber 16, the gap 15 and the second channel 14 during the cleaning process. At least one additional advantage is thus that by the third channel 47, a flow speed of at least 1.5 m/s can be achieved through the third channel 47, the curved chamber 16, the gap 15 and the second channel 14.

Now returning to FIGS. 2 and 3, note that the swivel arrangement 3 further comprises a steam inlet 43 and a steam outlet 44 formed in the pipe connecting part 5. The steam inlet 43 is in fluid communication with the steam outlet 44 via a steam channel 40 formed between the steam inlet 43 and the steam outlet 44. The steam channel 40 is formed in the pipe connecting part 5 and at least an inner wall of the steam channel comprises a surface of the metal bushing 10. During use, a flow of steam may be led between the steam inlet 43 and the steam outlet 44. The flow of steam may comprise steam at a temperature in the range of 90-200° C., preferably about 120° C. The flow of steam creates a steam barrier which sterilizes any contaminants which may have reached that position within the swivel arrangement 3. Note that the upper pair of seals 9 are arranged between the flow of steam and the chamber 16 and thereby prevents the flow of steam from entering the chamber 16.

In use, the method or process for operating the swivel arrangement 3 for the carousel filler arrangement 1 comprises the steps of feeding a liquid product through the product pipe 4 into the rotating tank 2, and providing a flow of gaseous media from the first opening 45 to the second opening 46 via the first and second channels 13, 14. The path from the second channel 14 means the flow of gaseous media flows over the gap 15, through the curved chamber 16 and the third channel 47 and is ejected through the second opening 46.

The method may further optionally comprise the step of providing a flow of steam through the steam channel 40 in order to ensure that any contaminant which may have entered the swivel arrangement 3 from below the steam channel 40 area sterilized before encountering component further up along the axial direction towards the curved chamber 16.

The swivel arrangement 3 according to the present invention may also be used to advantage during a cleaning process of the swivel arrangement and/or the carousel filler arrangement 1. A method for cleaning the swivel arrangement 3 and/or carousel filler arrangement 1 may comprise the step of providing a cleaning media through the product pipe into the rotating tank. Another step comprises providing a cleaning media through the first opening into the rotating tank via the first channel. Another step comprises providing a cleaning media through the second opening into the rotating tank via the second channel. Hence, it should be understood that the second opening may be used as an inlet during the cleaning process. In particular, the third channel being placed at least partly tangentially with respect to the curved chamber enables the flow speed of the cleaning media to be at least 1.5 m/s. A subsequent step may comprise providing steam through the product pipe, the first opening and the steam inlet subsequently or simultaneously in order to flush the channels and surfaces of the swivel arrangement 3 from the cleaning media and sterilize the channels and surfaces thereof. The steam may comprise steam at a temperature in the range of 90-200° C., preferably about 120° C.

The term providing cleaning media may be understood as feeding or creating a flow of cleaning media in either gaseous or liquid form in order to clean and/or sterilize the internal surfaces of at least the swivel arrangement 3.

FIGS. 5-8 shows a swivel arrangement according to an alternative embodiment of the invention. The main difference to the embodiments shown in FIGS. 2-4 being that the swivel arrangement therein further comprises an intermediate part 7 which reduces the relative speed between the tank connecting part 6 and pipe connecting part 5.

Figure 5:
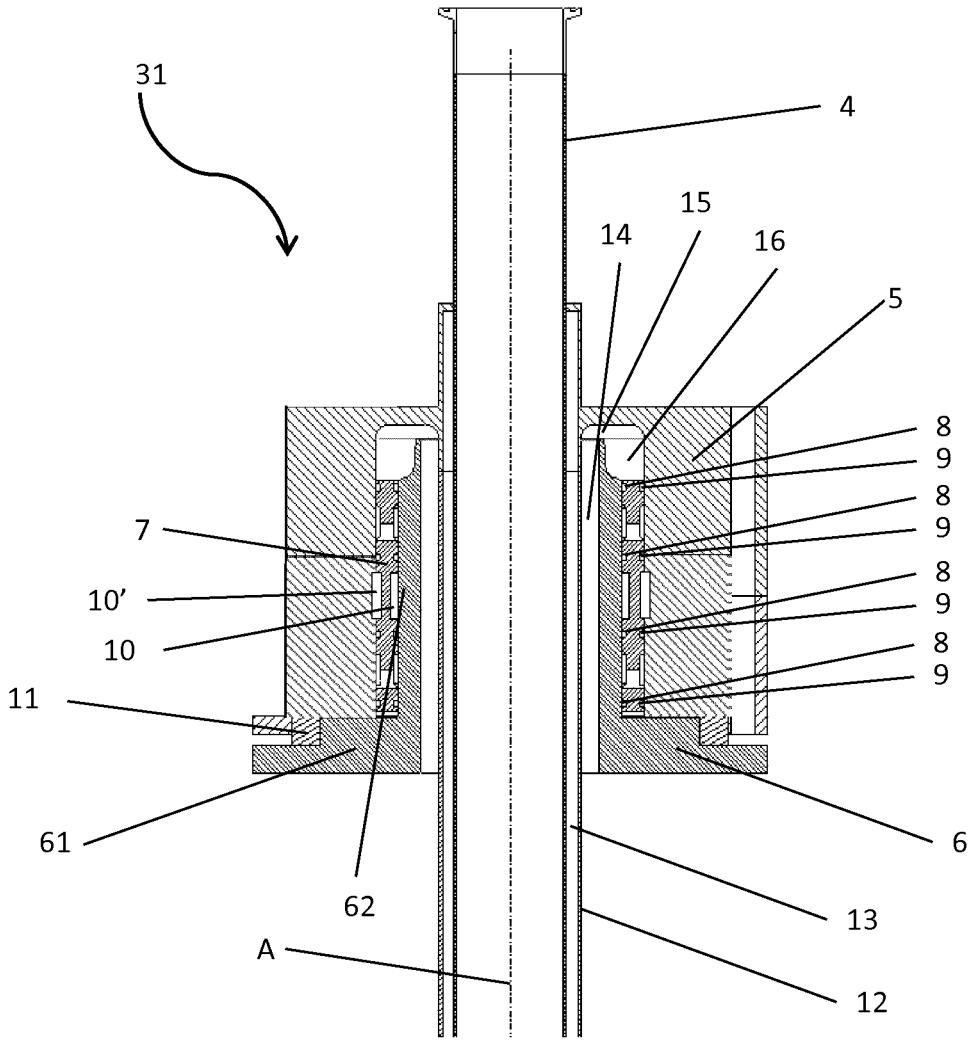
FIG. 5 is a cross-sectional schematic view of a swivel arrangement for a carousel filler arrangement in accordance with at least one embodiment of the invention.

FIG. 5 shows a detailed cross sectional view of the swivel arrangement 31 in accordance with at least one embodiment of the invention. Note that the tank connecting part 6 comprises a base plate 61 and a protruding portion 62 which extends from the base plate 61. The base plate 61 has a radial extension from the axis of rotation A and the protruding portion 62 extends in parallel with the axis of rotation A. The intermediate part 7 is elongated and arranged with its longitudinal axis in parallel with the axis of rotation A. The intermediate part 7 is arranged in a radial direction from the protruding portion 62 between the protruding portion 62 and the pipe connecting part 5. Hereby, it is understood that protruding portion 62 of the tank connecting part is shaped in the form of a cylinder, and that the intermediate part 7 is formed as a cylinder which at least partly surrounds the protruding portion 62 of the tank connecting part. The pipe connecting part 5 thus surrounds the intermediate part 7 and the protruding portion 62 of the tank connecting part in radial direction from the axis of rotation A.

The swivel arrangement further comprises a rolling bearing 11 arranged between the base plate 61 of the tank connecting part 6 and the pipe connecting part 5 in order to allow them to freely rotate with respect to each other.

The swivel arrangement 3 comprises a first set of seals 8 arranged between the tank connecting part 6 and the intermediate part 7, and a second set of seals 9 arranged between the pipe connecting part 5 and the intermediate part 7. The first and second set of seal 8, 9 prevents contaminations from entering the tank through a path between the tank connecting part 6 and the intermediate part 7 and a path between the pipe connecting part 5 and the intermediate part 7.

The swivel arrangement 3 comprises a first bushing 10 arranged between the tank connecting part 6 and the intermediate part 7, and a second bushing 10' arranged between the pipe connecting part 5 and the intermediate part 7.

The intermediate part 7 shown in FIG. 1 may be driven by internal means for driving the intermediate part 7. The internal means for driving the intermediate part may be at least one of: a gear (not shown) connected to the tank connecting part, a bushing, a rolling bearing. Hence, as is shown in FIG. 1 the intermediate 7 part is mechanically connected to the tank connecting part 6 through e.g. the first and second bushing 10, 10' which are configured to provide the torque required to rotate the intermediate part 7. A gear (not shown) may be arranged between the tank connecting part 6 and the intermediate part 7 and provide a gear ratio such that the intermediate part rotates with a rotational speed which is less than the rotational speed of the tank connecting part. Hence, it should be understood that the internal means for driving the intermediate part drives the intermediate part 7 in the same rotational directions as the tank connecting part 6.

The pipe connecting part 5 comprises a protruding portion 12 extending in parallel with the product pipe 4. The protruding portion 12 together with the outer wall of the product pipe 4 defines a first channel 13. The protruding portion 12 also defines a second channel 14 together with protruding portion 62 the tank connecting part 14. The second channel 14 is in fluid communication with a gap 15 defined between the protruding portion 62 of the tank connecting part 6 and the pipe connecting part 5. The gap 15 is in fluid communication with a chamber 16, and the further working of the first channel 13, second channel 14, gap 15 and chamber 16 are further explained below in connection to FIG. 4.

Figure 6:
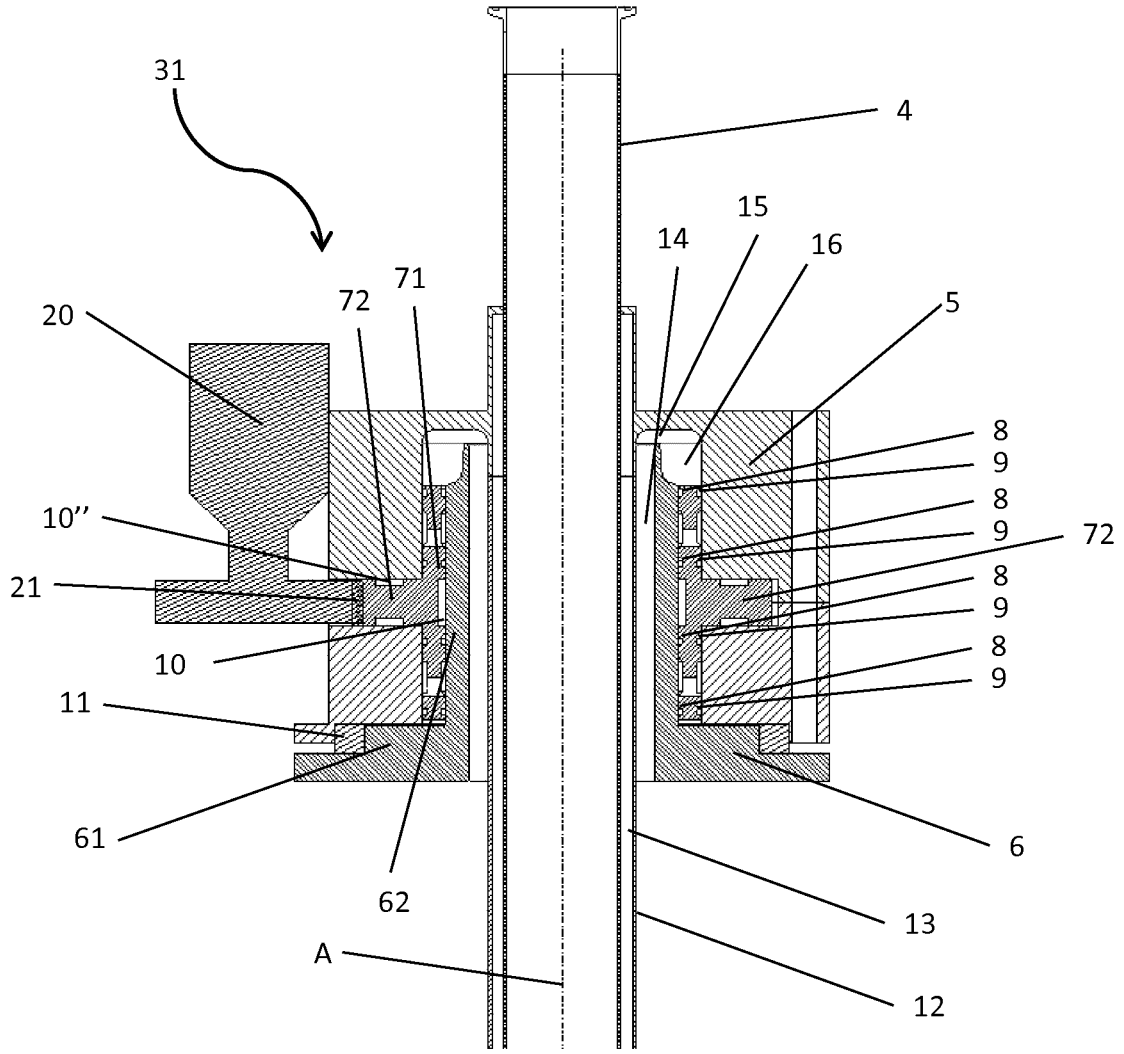
FIG. 6 is a cross-sectional schematic view of a swivel arrangement for a carousel filler arrangement in accordance with at least one embodiment of the invention.

FIG. 6 shows a cross-sectional schematic view of a swivel arrangement 31 in accordance with at least one embodiment of the invention. The same reference number refers to the same element as in FIG. 5, and those features and components are appreciated to be essentially similar. A difference between the embodiment shown in FIG. 5 and the embodiment shown in FIG. 6 is that the intermediate part comprises an axial portion 71 and a radial portion 72. The axial portion 71 extends substantially parallel to the axis of rotation A. The radial portion 72 extends outwards in a radial direction from the axis of rotation A. The radial portion 72 comprises a gear 21 at the outer end in order to mesh and engage with external means 20 for driving the intermediate part. The external means 20 may be any suitable component or components providing the possibility to drive the intermediate part such as an electrical motor, a hydraulic motor, or connections to further means for driving the rotation of the intermediate part 7. Further means for driving the rotation of the intermediate part 7 may be a chain, an additional gear, or a drive shaft.

Note that at second bushing 10" in the embodiment shown in FIG. 6 is arranged at the radial portion 72 of the intermediate part in order to provide a bearing surface between the radial portion 72 of the intermediate part and the pipe connecting part 5.

Figure 7:
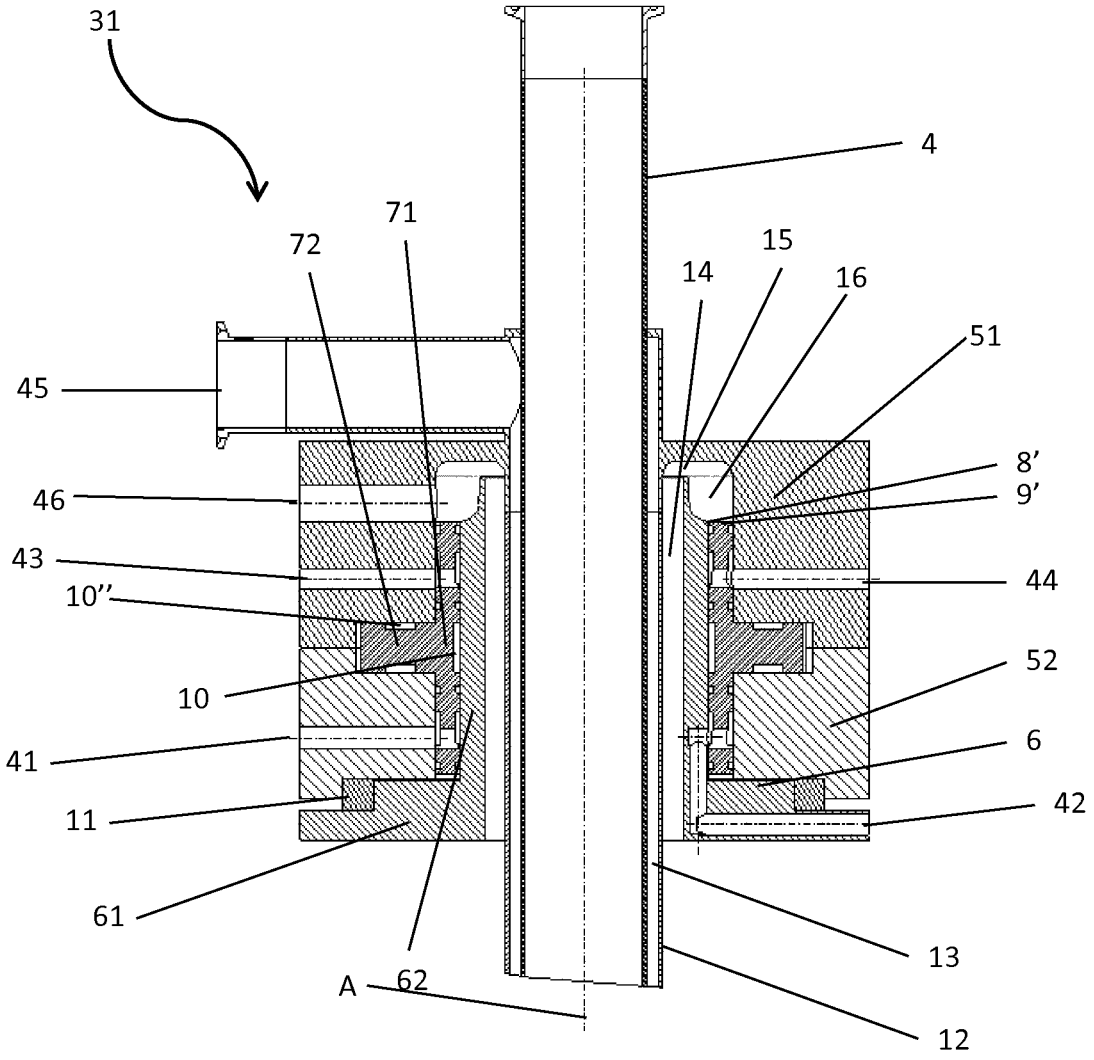
FIG. 7 is a cross-sectional schematic view of a swivel arrangement for a carousel filler arrangement in accordance with at least one embodiment of the invention.

FIG. 7 is a cross-sectional schematic view of the swivel arrangement 31 shown in FIG. 3 seen from another angle. In FIG. 4 channels for steam and sterile air flow is also shown. Further, the pipe connecting part comprises an upper portion 51 and a lower portion 52.

An air inlet 41 is provided in the lower portion 52 of the pipe connecting part. The air inlet 41 is in fluid communication with an air outlet 42 in the base plate 61 of the tank connecting part. During use, a flow of e.g. sterile air or the like may be led through the channel formed between the air inlet 41 and the air outlet 42 in order to prevent contaminants from entering or penetrating through the path between the lower portion 52 of the pipe connecting part and the intermediate part 71, 72, and between the lower portion 52 of the pipe connecting part and the protruding portion 62 of the tank connecting part.

The swivel arrangement 31 comprises a first opening 45 at least for receiving a gaseous media. The first opening 45 may be arranged outside the upper portion 51 of the pipe connecting portion as shown in FIG. 4. The swivel arrangement 31 comprises a second opening 46 at least for ejecting the gaseous media. As mentioned above in connection with FIG. 2 the first channel 13 at least partly defined by the protruding portion 12 of the pipe connecting part and an outer wall of the product pipe 4. The first channel 13 terminates in the tank at a tank opening (not shown) such that a flow of gaseous media which enters the first opening 45 is led through the first channel 13 to the tank opening (not shown), and may then enter the second channel 14, which is thereby in fluid communication with the first channel 14 via the rotating tank 2. The second channel 14 is at least partly defined by the protruding portion 12 of the pipe connecting part and the protruding portion of the tank connecting part 62. The gap is formed between the interior of the upper portion 51 of the pipe connecting part and an upper end of the protruding portion 62 of the tank connecting part. The gap is located between the second channel 14 and the second opening 46. During use, a continuous flow of gaseous media is directed from the first opening 45 to the second opening 46 via the first and second channels 12, 13. Thereby, a particle barrier is formed such that particles are hindered from entering the second channel 14 and falling into the tank where they may contaminate the product. The particle barrier is thus provided at least partly by the positive flow of a gaseous media through the second channel 14, and the gap 15, and partly by the protruding portion 62 of the tank connecting part which extends further than the chamber 16 such that the force of gravity pulls particles which have entered the chamber 16 away from the gap 15 as shown in FIG. 4.

The swivel arrangement 31 further comprises a steam inlet 43 and a steam outlet 44 formed in the upper portion 51 of the pipe connecting part. The steam inlet 43 is in in fluid communication with the steam outlet 44 via a steam channel defined between the steam inlet 43 and the steam outlet 44. During use, a flow of steam may be led between the first and second steam openings 43, 44. The flow of steam comprises steam at a temperature in the range of 90-200° C., preferably about 120° C. The flow of steam creates a steam barrier which sterilizes any contaminants which may have reached that position within the swivel arrangement 31. Note that the upper pair of seals 8' and 9' are arranged between the flow of steam and the chamber 16 and prevent the flow of steam from entering the chamber 16.

The terms 'inlet' and 'outlet' should in the above not be construed as limiting, it is of course possible that an inlet or an outlet be used the other way around, e.g. that the inlet functions as an outlet and vice versa where the flow through the inlet our outlet would provide the same function.

The skilled person realizes that a number of modifications of the embodiments described herein are possible without departing from the scope of the invention, which is defined in the appended claims.

The invention claimed is:

1. A swivel arrangement for a carousel filler arrangement having a rotating tank and a product pipe for transporting product into the rotating tank, said swivel arrangement comprising:

a tank connecting part arranged to rotate with the rotating tank;

a pipe connecting part arranged to at least partly surround the tank connecting part;

a first opening at least for receiving a gaseous media;

a second opening at least for ejecting the gaseous media;

a first channel in fluid communication with the first opening, the first channel being at least partly defined by a protruding portion of the pipe connecting part and an outer wall of the product pipe; and a second channel in fluid communication with the first channel, the second channel being at least partly defined by the protruding portion of the pipe connecting part and a protruding portion of the tank connecting part;

wherein a gap is formed between the pipe connecting part and the protruding portion of the tank connecting part, the gap being located between the second channel and the second opening to form a particle barrier whereby, when the swivel arrangement is in use, particles are hindered from entering the second channel by a flow of gaseous media from the first opening to the second opening via the first and second channels.

2. The swivel arrangement according to claim 1, wherein the size of the gap is configured such that a pressure drop over the gap is adapted to create a uniform flow through the gap.

3. The swivel arrangement according to claim 1, wherein the gap is 5-30 mm wide.

4. The swivel arrangement according to claim 1, wherein the swivel arrangement further comprises a curved chamber, the curved chamber being arranged in fluid communication with the gap and the second opening, wherein the curved chamber extends circumferentially around the protruding portion of the tank connecting part.

5. The swivel arrangement according to claim 4, further comprising a third channel being in fluid communication with the curved chamber and the second opening, wherein the third channel is arranged at least partly tangentially with respect to the curved chamber.

6. The swivel arrangement according to claim 1, further comprising a metal bushing arranged between the pipe connecting part and the protruding portion of the tank connecting part.

7. The swivel arrangement according to claim 6, further comprising at least one seal arranged between the metal bushing and the pipe connecting part, and further comprising at least one seal arranged between the metal bushing and the protruding portion of the tank connecting part.

8. The swivel arrangement according to claim 1, further comprising at least two rolling bearings, the at least two rolling bearing being arranged between the protruding portion of the tank connecting part and the pipe connecting part, and the at least two rolling bearing being spaced apart from each other.

9. The swivel arrangement according to claim 8, wherein the at least two rolling bearings being spaced apart by a distance corresponding to at least half the length of the protruding portion of the tank connecting part.

10. The swivel arrangement according to claim 6, further comprising:

a steam inlet;

a steam outlet; and a steam channel formed in the pipe connecting part between the steam inlet and the steam outlet, wherein at least an inner wall of the steam channel comprises a surface of the metal bushing.

11. The swivel arrangement according to claim 1, wherein the first channel and the second channel are substantially parallel.

12. The swivel arrangement according to claim 1, further comprising at least one spray nozzle arranged at an end portion of the protruding portion of the pipe connecting part.

13. The swivel arrangement according to claim 1, further comprising an intermediate part arranged between the tank connecting part and the pipe connecting part, the intermediate part being arranged to rotate at a rotational speed different from a rotational speed of the tank connecting part.

* * * * *